US007546934B2

(12) United States Patent
Reinsel et al.

(10) Patent No.: US 7,546,934 B2
(45) **Date of Patent: *Jun. 16, 2009**

(54) GRAVITY-FEED NAPKIN DISPENSER WITH INTERNAL BLOCKING ASSEMBLY

(75) Inventors: Christopher M. Reinsel, Neenah, WI (US); Robert J. Aloisi, Sheboygan Falls, WI (US)

(73) Assignee: Georgia-Pacific Consumer Product LP, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/968,691

(22) Filed: Jan. 3, 2008

(65) Prior Publication Data

US 2008/0099497 A1 May 1, 2008

Related U.S. Application Data

(63) Continuation of application No. 11/153,749, filed on Jun. 15, 2005, now Pat. No. 7,341,166.

(60) Provisional application No. 60/589,622, filed on Jul. 21, 2004.

(51) Int. Cl.
*A47K 10/24* (2006.01)

(52) U.S. Cl. ..... 221/60; 221/59; 221/56; 221/279; 221/224; 221/226

(58) Field of Classification Search ..... 221/1–312 C
See application file for complete search history.

(56) References Cited

U.S. PATENT DOCUMENTS 4,838,454 A 6/1989 Salzmann et al.
5,100,020 A * 3/1992 Petterson et al. ..... 221/45
5,102,007 A * 4/1992 Petterson et al. ..... 221/6
5,156,293 A 10/1992 Petterson et al.
D331,515 S 12/1992 Petterson et al.
6,130,521 A 10/2000 Collins et al.
6,334,544 B1 1/2002 Christensen et al.
6,899,251 B2 5/2005 Christensen et al.
6,981,610 B2 1/2006 Smiley et al.
D520,277 S 5/2006 Smiley et al.
7,134,571 B2 11/2006 Hochtritt et al.
7,341,166 B2 * 3/2008 Reinsel et al. ..... 221/59
2005/0056657 A1 3/2005 Hochtritt et al.
2006/0118568 A1 6/2006 Hochtritt et al.

OTHER PUBLICATIONS

International Search Report and Written Opinion of the International Searching Authority dated Nov. 28, 2006 in connection with PCT/US05/24057.

* cited by examiner

*Primary Examiner*—Gene Crawford
*Assistant Examiner*—Michael K Collins
(74) *Attorney, Agent, or Firm*—Joel T. Charlton

(57) ABSTRACT

A gravity-feed dispenser includes an internal blocker assembly to prevent folded sheet from falling away from the dispensing aperture. A preferred embodiment includes a spring biased blocker arm which cooperates with a spring biased guide plate to maintain the napkins in position throughout dispensing of the stack, especially when the stack is depleted and of insufficient weight to urge the remaining sheets into position. In a preferred embodiment, the dispenser is provided with a convertible support, suitable for mounting the dispenser on either a wall or a countertop with a quick release mounting bracket.

4 Claims, 12 Drawing Sheets

72
22
10

18
12
R'
16
28
60
14
54
34
32
27
29
35
74
24
30
42

72
22
10
12
18
R'
16
19
20
60
14
28
34
54
21
29
32
70
62
82
27
40
84
88
80
42
74
24
86
76
90
94

GRAVITY-FEED NAPKIN DISPENSER WITH INTERNAL BLOCKING ASSEMBLY

CROSS REFERENCE TO RELATED APPLICATIONS

This application is a continuation of U.S. application Ser. No. 11/153,749, filed Jun. 15, 2005, which claims the benefit of U.S. Provisional Application Ser. No. 60/589,622, filed Jul. 21, 2004. The priorities of the foregoing applications are hereby claimed and the entirety of their disclosures incorporated herein by reference.

TECHNICAL FIELD

The present invention relates generally to gravity-feed napkin dispensers, and more particularly to a gravity-feed napkin dispenser which includes a blocking assembly which operates to maintain napkins in a position available for dispensing through a dispensing aperture of the dispenser.

BACKGROUND ART

Gravity-feed napkin dispensers are well known. In this respect there is shown in U.S. Pat. No. 5,100,020 to Petterson et al. a dispenser for serially dispensing products such as paper napkins from a stack. The dispenser apparatus includes a housing having a back wall which is curved and has a radius of curvature generally corresponding to the radius of curvature of the stack.

In U.S. Pat. No. 5,102,007 also to Petterson et al. there is shown an improvement to the '020 patent wherein the dispenser is provided with a blocking member which obstructs the interior of the housing above a stack after the stack has been shortened to a predetermined degree to prevent an upward force against the stack from moving the stack away from its dispensing position. See also U.S. Pat. No. 5,156,293 and U.S. Pat. No. Des. 331,515 to Petterson et al.

The dispenser illustrated in the foregoing patents is configured to receive a stack of single-fold, non-interfolded napkins and supports them inside a gently curving housing having a substantially rectangular cross section which is inclined from a vertical at an angle of approximately 10° at its upper extremity and approximately 25° at its lower extremity. Accordingly, the surfaces of the napkins are substantially horizontal nearer the upper extremity of the dispenser, but are rather more inclined with respect to a horizontal position in the lower portion of the dispenser. When filled, the napkins lie against a face plate which constitutes the lower surface of the dispenser, but a portion of the weight of the stack is borne by the back wall of the dispensing cavity which ameliorates jamming problems which might occur if the entire weight of the stack of napkins were borne by the face plate.

One operating difficulty with this type of dispenser is that when a napkin stack becomes almost completely depleted, there is a tendency for the few remaining napkins in the dispenser to fall back against the rear or back wall rather than lying against the dispensing face plate which has the dispensing aperture formed therein. When the napkins fall back, it makes it difficult for a user to grasp a single napkin and withdraw one through the opening. Accordingly, this drawback can defeat the purpose of the dispenser which is to make it easy for the user to withdraw a single napkin but more difficult to withdraw multiple napkins at the same time. The '007 patent addresses this problem by providing an opening or recess in the back wall of the dispensing cavity spaced perhaps an inch or two above the lower face plate of the dispenser through which a J-shaped blocking arm extends. The arm hingedly mounts on the dispenser such that it can be pivoted so that the hook of the J is able to move through an opening into the interior of the dispenser. A light spring urges the J-shaped locking member away from the back wall of the dispenser and into the dispensing cavity; however, the spring constant is chosen to ensure that the weight of the stack of napkins will be sufficient to urge the blocker arm against the rear surface of the dispensing cavity so that it does not interfere with the gravity feeding of the napkins. While the J-shaped blocking member prevents the last several napkins from falling against the rear wall of the cavity, as it rotates into position a few napkins are often carried upwardly by the vertical stroke portion of the J-shaped blocking member and carried away from the dispensing aperture. Some product thus becomes either pressed against the front wall of the dispenser or is otherwise made inaccessible to a user.

SUMMARY OF INVENTION

The present invention improves the dispenser of U.S. Pat. No. 5,102,007 by providing a pivoting guide member mounted just below the J-shaped blocker arm of the '007 patent in order to provide a blocking assembly with a blocking surface which includes a leading guide plate to reduce misfed sheets. The assembly includes opposed biasing means and is configured so that as the blocker arm is rotated upward and into deployment, the guide plate is rotated downward against the rearward portion or upper surface of the stack of folded sheets, preventing the uppermost sheets in the stack from being displaced by upward rotation of the blocker arm. The guide member is spring loaded to urge it against the blocker arm, but spring loaded lightly enough so that it rotates away from the upper surface of the J-shaped arm as the arm rotates when the stack of napkins is depleted.

During loading, as the dispenser is loaded with napkins, the weight of the napkins is sufficient to urge the blocking assembly against the back wall of the dispensing cavity so that the dispensing cavity is unobstructed. In that position, the guide member is nested within a recess formed at the lower extremity of the vertical stroke (bottom) portion of the J of the J-shaped blocker arm. As a stack of napkins is depleted, the force against the J-shaped blocker arm which urges it against the rear wall of the dispensing cavity decreases as the weight of the napkins engaging it lessens and a spring thus biases the J-shaped arm into the cavity while urging the guide member downward thereby maintaining the uppermost sheets in the stack in their proper position for deployment so that they may be withdrawn through the dispensing aperture and are not displaced away from it as the J-shaped blocking member pivots into the cavity.

More generally, there is thus provided in accordance with the present invention a gravity feed dispenser including a housing having an upper and lower end including walls defining an interior for accommodating a stack of folded sheet products within the interior. The folded sheet products have edges and generally planar faces and the interior of the housing is of a size and configuration to allow slideable movement of the stack of folded sheet products under the influence of gravity upon depletion of the stack. A dispensing aperture is disposed at a lower end of the housing in communication with its interior, the aperture allowing manual access to the folded sheet product at the bottom of the stack. A blocking assembly having a blocking surface operatively associated with the housing and responsive to shortening of the stack to a predetermined stack length restricts movement of a depleted stack within the interior. The blocking assembly is moveable between a first position wherein the blocking surface is substantially out of the housing interior and does not interfere with axial movement of the stack within the housing interior until the stack length approaches the predetermined stack length and a second position wherein the blocking surface projects into the housing and is engageable by the generally planar surfaces of the sheets so as to restrict movement of the folded sheets away from the dispensing aperture in the second position. The blocking assembly includes a primary blocker arm, primary biasing means, a guide member and secondary biasing means. The blocking assembly is biased in the second position by the primary biasing means, while the primary blocking means, the secondary biasing means, and the guide member are configured and adapted such that the stack of folded sheets will substantially maintain the blocking assembly in the first position when the stack of folded sheets is longer than the predetermined stack length and the primary biasing means will urge the blocking assembly toward the second position as the stack approaches the predetermined stack length. The guide member is biased away from the interior of the dispenser by the secondary biasing means in the first position of the assembly and is coupled to the primary blocker arm. The guide member and secondary biasing means are further adapted such that the guide member projects into the interior of the dispenser housing upon movement of the blocking assembly toward the second position by motion of the primary blocker arm acting on the guide member to provide a guide surface operative to direct product away from the primary blocker arm and toward the dispensing aperture. In typical embodiments the housing has a curved back wall and may be inclined with respect to a vertical at an average angle of from about 10° to about 40°. Preferably, in the second position the blocking assembly provides a blocking surface extending substantially between the back wall to the front wall of the dispenser in spaced facing relationship with the dispensing aperture at a distance therefrom.

Typically, the housing has a recess configured to receive the primary blocker arm in the first position such that the blocking arm does not obstruct the interior of the housing. Likewise, the primary blocker arm may be provided with a guide member recess wherein the guide member nests in the recess when the blocking assembly is in the first position. The blocking arm may be generally J-shaped as described in the aforesaid U.S. Pat. No. 5,102,007 to Petterson et al. The blocker arm is typically hinged to the housing. So also, the guide member is typically a plate, such as a T-shaped plate also hinged to the housing. The guide member preferably veers upwardly with respect to a lower portion thereof as will be appreciated from the drawings. The guide member may thus be generally curved toward the blocker arm, bent toward the blocker arm or inflexed toward the blocker arm with curved and straight portions.

The primary biasing means and the secondary biasing means may include springs, such as axle springs if so desired or a simple axially acting spring if so desired.

The housing of the dispenser is optionally provided with axially extending restricting means configured to engage the stack defining at least two regions of maximum restriction in the interior of the dispenser. A lower region of maximum restriction is from about ½ to about 1.5 times the predetermined stack length from the lower end of the dispenser, while an upper region of maximum restriction is from about 1 to about 3 times the predetermined stack length from the lower end of the housing.

A back wall of the housing makes an angle of from about 10 to about 60 degrees with a vertical at the lower end of the dispenser, typically from about 30 to about 50 degrees and about 40 degrees in one preferred case.

In one preferred embodiment there is provided a dispenser for serially dispensing discreet folded sheet products from a stack thereof, each folded sheet product having generally planar surfaces and being of non-uniform thickness and having a first edge portion thereof thicker than a second edge portion thereof, whereby said folded sheet products when stacked with the first edge portions and second edge portions in respective alignment and the first and second edge portions of each folded sheet product in respective engagement of the first and second edge portions of adjacent folded sheet products, will, in the absence of outside forces applied to the folded sheet products, form a stack with a bend along the length thereof, having a predetermined radius of curvature, the dispenser apparatus includes: a housing defining an interior for accommodating the stack of folded sheet products, having a front and upper end, a lower end and including a back wall, the back wall being generally smoothly curved. There is provided a dispensing aperture at the lower end of the housing, the dispensing aperture being in communication with the housing interior for allowing manual access and removal of the lower most folded sheet products in the stack. The first edge portions of the stacked folded sheet products are in slideable engagement with the generally curved housing back wall during downward movement of the stack within the housing interior under the influence of gravity upon removal of the lower most folded sheet product therefrom. The housing back wall curves generally towards the housing front at the lower end of the housing and the housing back wall supports, at least in part, the folded sheet products within the housing interior at the lower end of the housing at the first edge portions thereof to relieve stack pressure on the folded sheet products at the lower end of the housing. A blocking assembly having a blocking surface is operatively associated with the housing and is responsive to shortening of the stack of folded sheets during depletion thereof toward a predetermined stack length to restrict movement of the stack within the housing interior. The blocking assembly is moveable between a first position wherein the blocking surface is substantially out of the housing interior and does not interfere with axial movement of the stack within the housing interior until the stack length approaches the predetermined stack length and a second position wherein the blocking surface projects into the housing interior and is engageable by the generally planar surfaces of the sheets so as to restrict movement of the product away from the dispensing aperture in the second position. The blocking assembly includes a primary blocker arm, primary biasing means, a guide member and secondary biasing means. The blocking assembly is biased in the second position by the primary biasing means. The primary blocking means, secondary biasing means and guide member are configured and adapted such that the stack of folded sheets will substantially maintain the blocking assembly in the first position when the stack of folded sheets is longer than the predetermined stack length and the primary biasing means will urge the blocking assembly toward the second position when the stack approaches the predetermined stack length. The guide member is biased away from the interior of the dispenser by the secondary biasing means in the first position of the assembly and is coupled with the primary blocker arm. The guide member and secondary biasing means are further adapted such that the guide member projects into the interior of the dispenser housing upon movement of the blocking assembly toward the second position by motion of the primary blocker arm acting on the guide member to provide a guide surface operative to direct product away from the primary blocker arm and toward the dispensing aperture. Preferably, the curved back wall has a radius of curvature of from about ½ to about 2 times the predetermined radius of curvature of the stack and perhaps most preferably has the same or substantially the same radius of curvature.

In still yet another embodiment of the present invention, there is provided a gravity feed dispenser including: (a) a housing having a lower end and a supporting wall means for supporting and allowing slideable movement of a stack of folded rectangular planar sheet product down said arcuate supporting wall means under the influence of gravity during depletion of said stack; (b) a dispensing aperture means disposed at said lower end of said housing in communication with said interior for allowing manual access to the folded sheet product at the bottom of said stack; and (c) a blocking means responsive to shortening of the stack of folded sheet products during depletion thereof for restricting movement of the stack within said housing interior, including: (i) a downwardly pivotable minor blocking arm means for maintaining the uppermost folded sheet products within said stack in an orientation which is generally parallel to the folded sheet products adjacent said dispensing aperture means; and (ii) an upwardly pivotable major blocking arm means for urging the downwardly pivotable minor blocking arm means against the upper surface of said stack of folded rectangular planar sheet product.

Preferably the supporting wall means includes a supporting wall with an arcuate profile as is best seen in FIGS. 7-9.

In another embodiment of the present invention there is provided a method of dispensing folded sheet products of non-uniform thickness utilizing the dispenser described above. Preferably the dispenser is inclined with respect to a vertical. Inasmuch as the back wall of the dispenser has a radius of curvature it makes a first angle with a vertical at the upper portion thereof, of from about 5 to 20° and a second angle with a vertical at the lower portion thereof of from about 10° to about 60°. The average angle of inclination of the dispenser with respect to a vertical is calculated by using a line through the center of the lower (front) and top (rear) walls of the dispenser.

Preferably the dispenser of FIGS. 1-9 is provided with a convertible support suitable for mounting the dispenser on either a countertop or wall having an upper support member secured to the dispenser, a lower support member secured to the upper support member, wherein the two support members are moveable with respect to each other between a countertop support arrangement and a wall support arrangement, the two members extending generally in the same direction in the countertop support arrangement and being generally orthogonal to each other in the wall support arrangement; and means for securing the convertible support to a mounting surface. The support members are configured to support the dispenser in an upright orientation when the convertible support is secured to a horizontal support surface and the support members are in the countertop support arrangement relative to each other and wherein the support members are configured to support the dispenser in an upright orientation when the convertible support is secured to a vertical support surface and the support members are in the wall support arrangement relative to each other. In one preferred embodiment, the upper support member has a wedge shaped lower end and the lower support member has a wedge shaped upper end secured thereto and at least one of the support member is rotatable with respect to the other such that the support members can be converted from the countertop support arrangement to the wall support arrangement by relative rotation thereof.

The means for securing the convertible support to a supporting surface preferably includes: a) a base having an upper surface and a sidewall extending downwardly therefrom to define a hollow cavity and also define a locking recess; b) a mounting bracket provided with means for securing it to the supporting surface and a moveable tongue adapted to flex from a locking position to a release position, wherein at least one of the base and bracket is provided with a locking projection and at least one of the base and bracket is provided with a locking slot configured to cooperate with the locking projection to releasably secure the base to the bracket; and c) the base and mounting bracket further being configured such that the locking projection may be inserted into the locking slot and the base slid into a locking position with the bracket wherein a shoulder of the locking projection is secured from perpendicular translation away from the locking position by an elongated narrow portion of the locking slot and the base is prevented from parallel translation away from the locking position until the tongue is flexed to its release position.

Other typical features of the convertible support include: a) support members adapted to rotate 180° with respect to each other between the countertop and wall support arrangements thereof; b) wherein the tongue requires a force of from about 2 to about 10 pounds to move it from the locking position to the release position; and c) biasing means to urge the base and bracket into engagement with each other in the locking position.

Still further aspects of the present invention are described in detail below with reference to the appended Figures.

BRIEF DESCRIPTION OF DRAWINGS

The invention is described in detail below with reference to the various Figures wherein like numbers designate similar parts. In the Figures.

DETAILED DESCRIPTION

Figure 1:
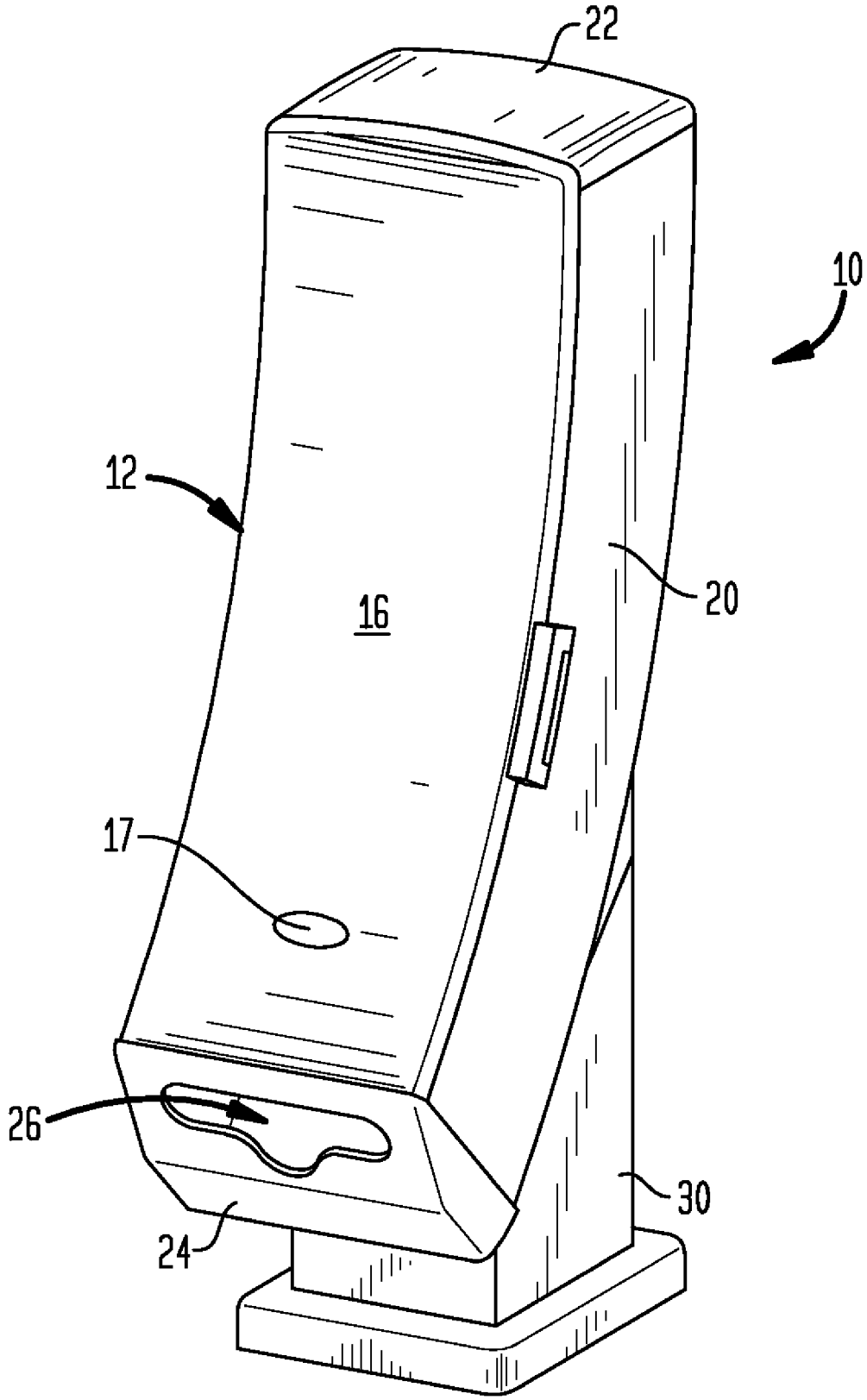
FIG. 1 is a perspective view of a napkin dispenser utilizing the internal blocking assembly of the present invention.
Figure 2:
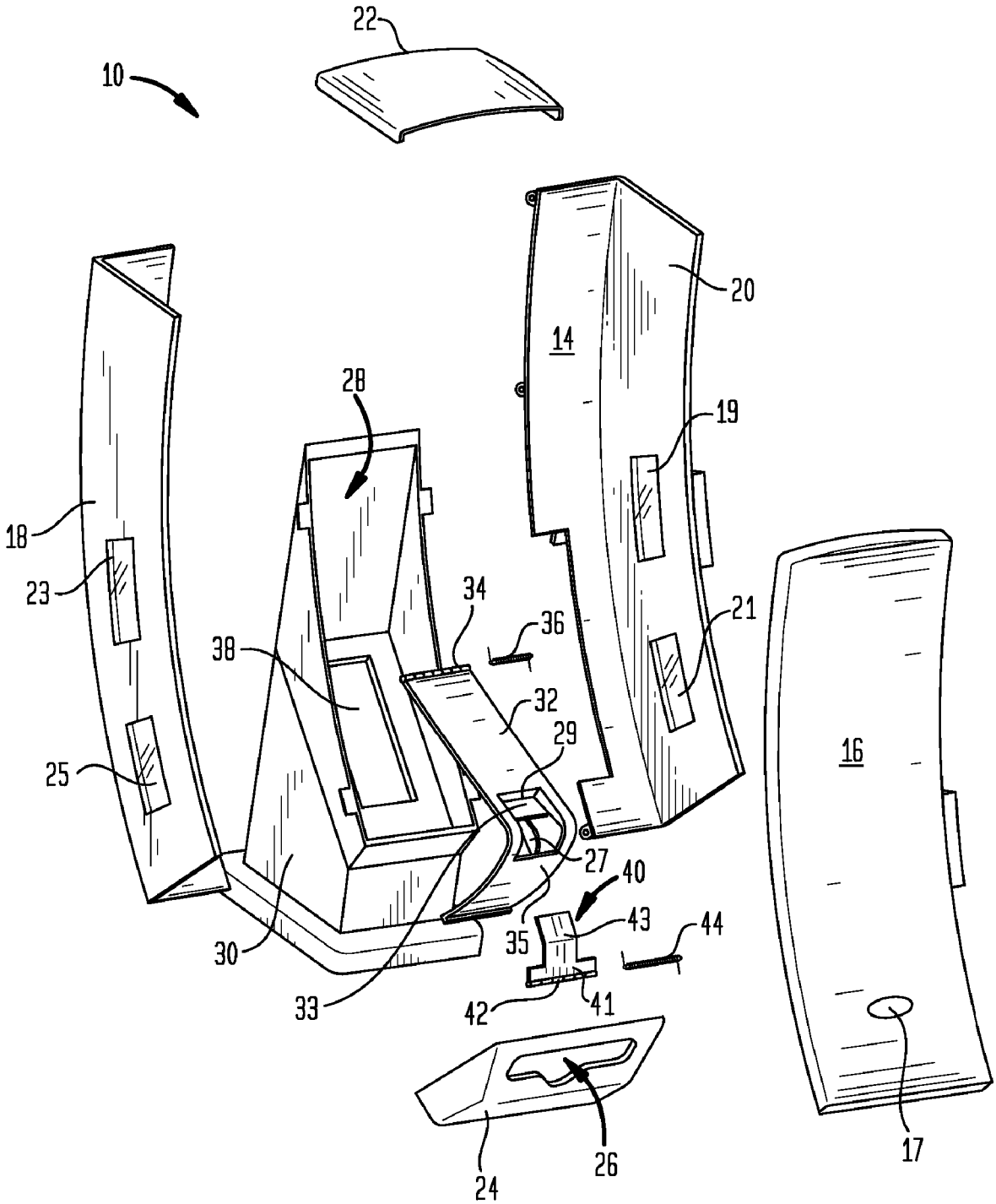
FIG. 2 is an exploded view schematically illustrating the parts of the napkin dispenser of FIG. 1.

The present invention is described in further detail below with reference to the various Figures for purposes of illustration. Modifications within the spirit and scope of the present invention, set forth in the appended claims, will be readily apparent to those of skill in the art.

Referring to FIGS. 1 through 9, there is shown a dispenser 10 having a housing 12 with a back wall 14, a front wall 16, optionally having a sight glass 17, for observing inventory, a sidewall 18, another sidewall 20, a top wall 22 and a bottom wall 24. Bottom wall 24 defines an aperture 26 which communicates with the interior of the housing, also referred to as cavity 28.

The dispenser is mounted on a support 30 and includes a blocker arm 32 mounted on a hinge 34 provided with an axle spring 36. Back wall 14 is provided with a recess 38 configured to receive the blocker arm in a first position wherein the blocker member is flush with the back wall and does not obstruct the interior of the dispenser (see FIGS. 4, 7). The dispenser is further provided with a guide plate 40 mounted on a hinge 42 on back wall 14 also provided with an axle spring 44, however any suitable biasing means may be used. Note that guide plate 40 has an inflexed geometry with lower panel 41 and upper inflexed panel 43. Guide plate 40 may be curved or have curved and straight portions as illustrated, preferably with the upper portion curving upwardly and toward the back wall when the dispenser is fully loaded. Blocker arm 32 includes a reinforcing rib 27 as well as a recess 33 provided with a pocket 29 with a bottom wall 31 configured to receive inflexed panel 43 in a loaded position shown schematically in FIGS. 4 and 7.

Figure 3:
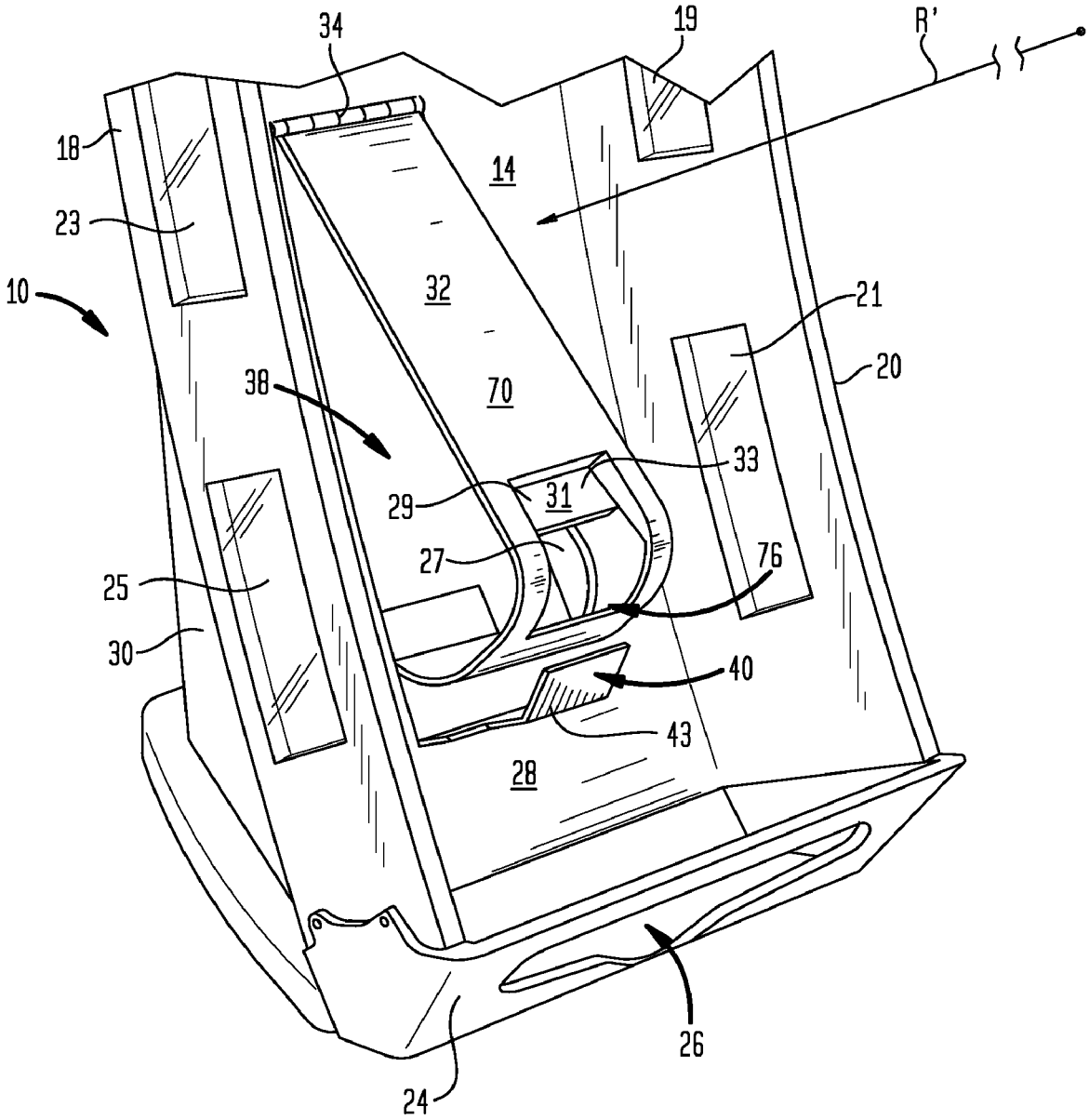
FIG. 3 is a partial view in perspective of the interior of the napkin dispenser of FIG. 1 showing the blocking assembly biased away from the back wall to its blocking position.
Figure 4:
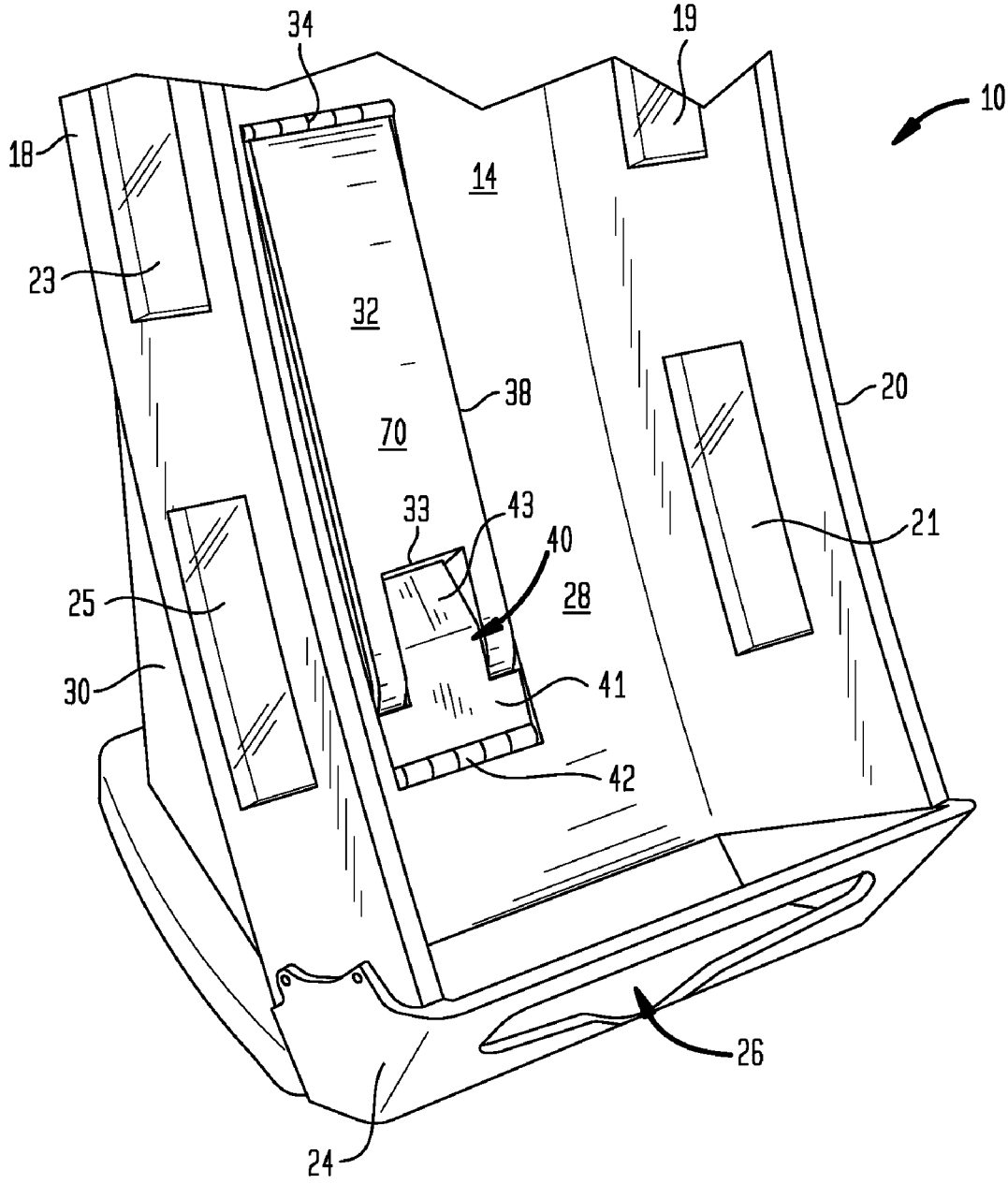
FIG. 4 is a partial view in perspective of the interior of the napkin dispenser of FIG. 1 showing the blocking member and guide plate in a first position substantially flush with the back wall of the napkin dispenser of FIG. 1 wherein the guide member is nested with the blocker arm.

In some embodiments, wall 31 may cover all of the bottom of recess 33, partial covering of the bottom of the recess being illustrated in FIG. 3.

Figure 5:
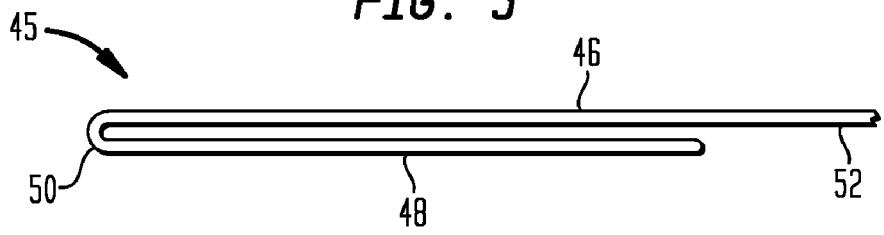
FIG. 5 is a schematic diagram of a folded sheet having different thicknesses at opposed edges thereof.
Figure 6:
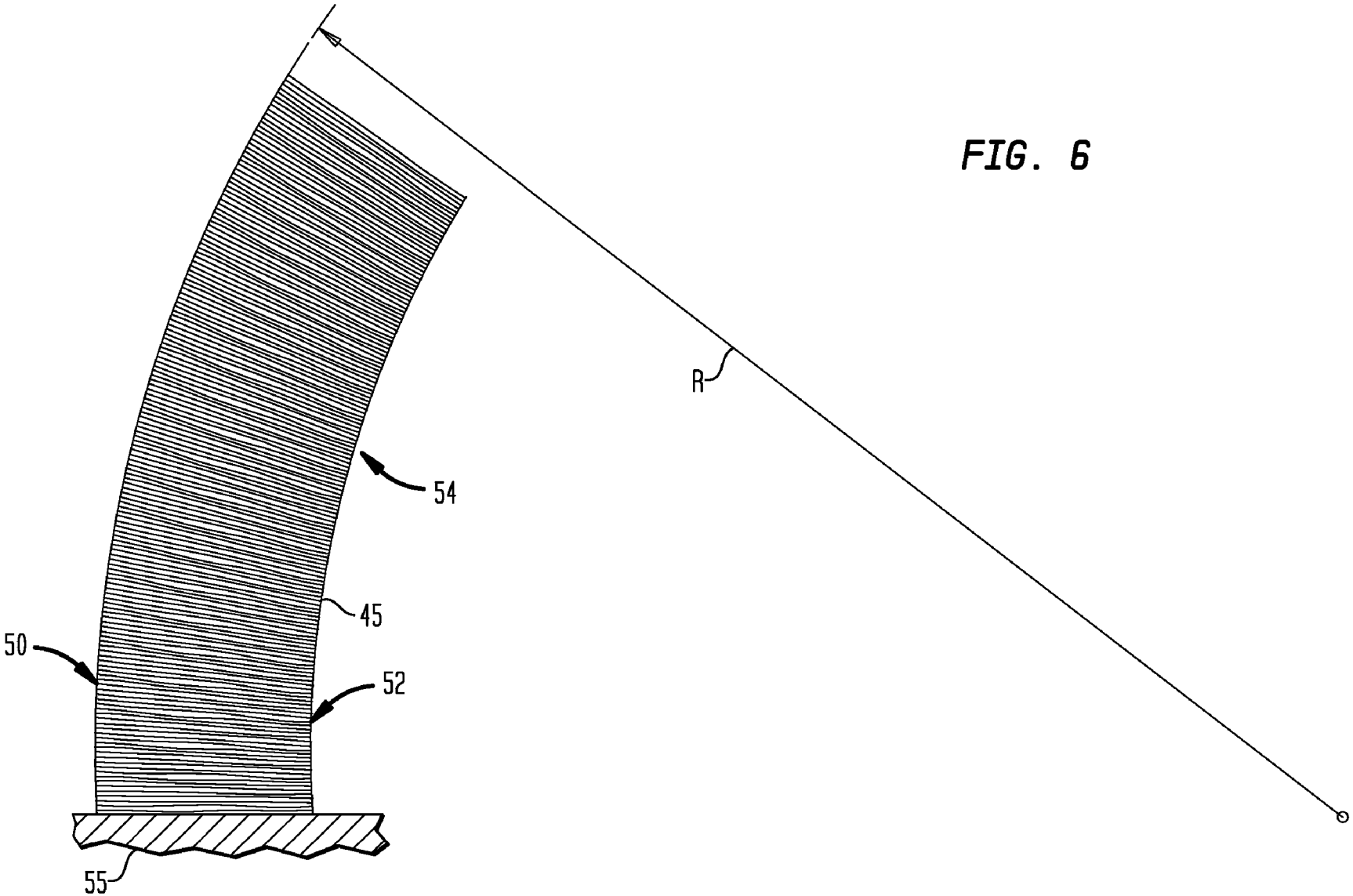
FIG. 6 is a schematic diagram illustrating the radius of curvature of a stack of folded sheets of the class shown in FIG. 5 assumed by the stack in the absence of other forces.

The napkin dispenser is particularly suitable for dispensing single fold, non-interfolded napkins of the class illustrated in FIGS. 5 and 6.

An individual folded napkin 45 includes an upper surface 46 as well as a lower surface 48. The napkin also has a first edge 50 which is generally thicker than second edge 52. Edge 50 is generally placed adjacent back wall 14 of the dispenser as will be appreciated with reference to the drawings and in particular in comparison of FIGS. 1 and 6.

FIG. 6 is a schematic view showing a stack 54 of individual napkins 45 placed upon a flat surface 55. As can be seen from the drawings because the edges 52 are thinner than edges 50 the stack, in the absence of other forces, will assume a radius of curvature, R.

Back wall 14 also has a radius of curvature R' corresponding to the radius of curvature R in preferred embodiments. R' may be equal to R or be different from R by a fixed amount generally within about 25% or so of the absolute value of R. In some cases, the differences in curvature are greater as noted above. The dispenser thus defines a first angle at 72 with respect to a vertical and a second angle at 74 with respect to a vertical. Angle 72 is advantageously from about 5 to 20 degrees while angle 74 is advantageously from about 10 to 60 degrees. In a typical embodiment, angle 72 is 10 degrees and angle 74 is about 40 degrees. The curved back wall helps to support the stack so that there is not too much pressure on the stack at the aperture when the dispenser is loaded with product. There are optionally provided a plurality of sidewall ridge members 19, 21, 23 and 25 which are configured to frictionally engage the stack and further support it. In one preferred embodiment a first region of maximum restriction is defined at the lower portion of ridges 21, 25 and a second region of maximum restriction is defined at the lower end of ridges 19, 23. The first region of maximum restriction is typically at predetermined stack length 62 from the lower end of the dispenser and the upper region of maximum restriction is twice the distance of the predetermined stack length from the lower end of the dispenser.

Operation of the inventive dispenser is especially appreciated by reference to FIGS. 3, 4 and 7 through 9.

In operation, a folded stack of napkins 54 is placed in cavity 28 of housing 12. When there is a full stack, stack 54 presses blocker arm 32 flush with back wall 14 which is received in recess 38. Axle spring 36 urges blocker member 32 away from the back wall and upwardly into the dispenser housing cavity, however, the weight of the undepleted stack is sufficient to hold blocker member 32 in the position shown in FIGS. 4 and 7 wherein blocker arm 32 is disposed in recess 38.

Guide plate 40 is urged into recess 33 of blocker member 32 by way of spring 44 when the dispenser is loaded with napkins. That is to say spring 44 urges T-shaped, inflexed plate 40 into recess 33 that is, in the opposite direction that spring 36 urges blocking member 32. As is shown especially in FIG. 4, inflexed panel 43 of plate 40 is received in pocket 29 of arm 32.

Figure 7:
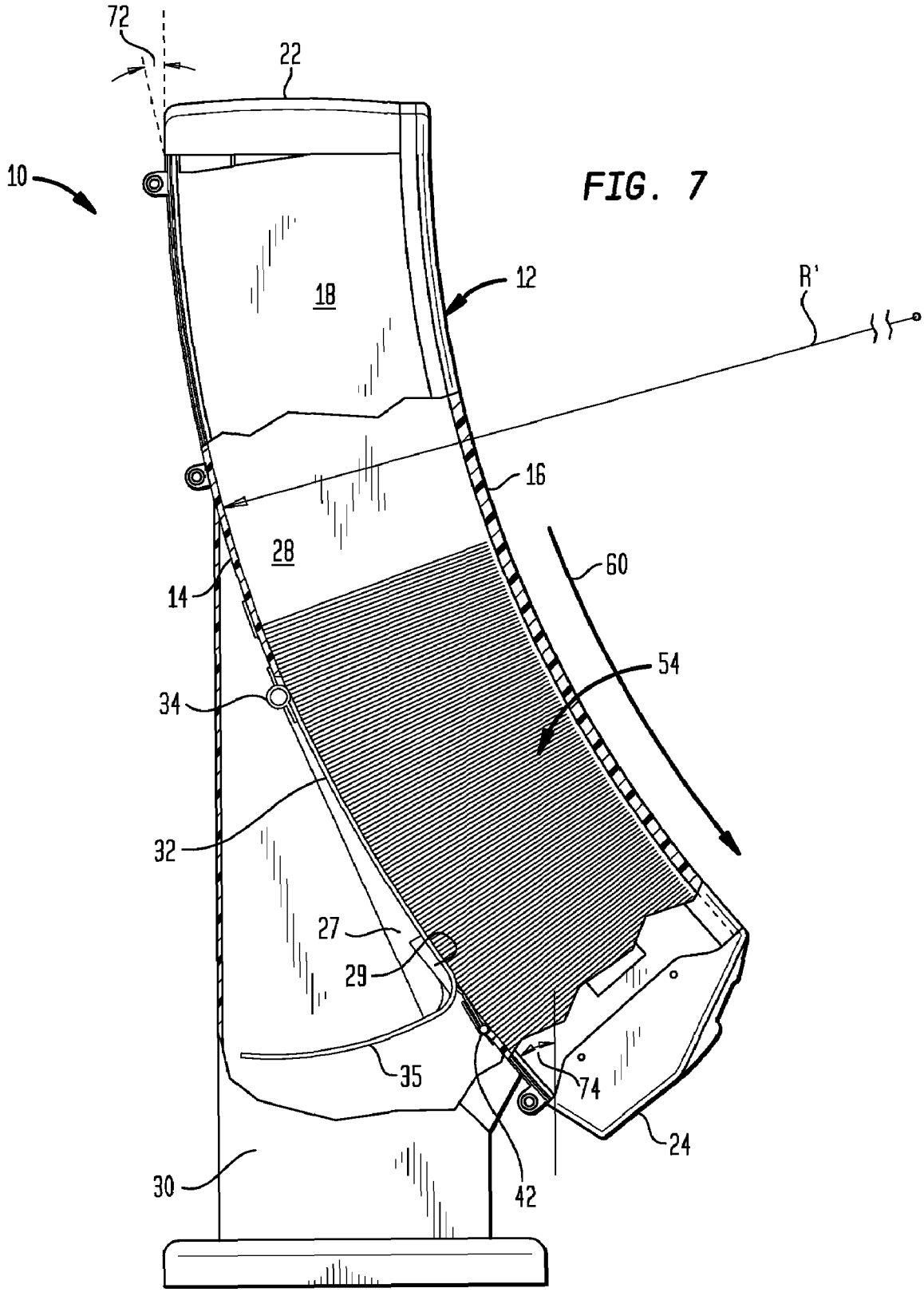
FIG. 7 through 9 are side views in elevation and partial section of the inventive napkin dispenser of FIG. 1 illustrating operation of the blocking assembly of the present invention.
Figure 8:
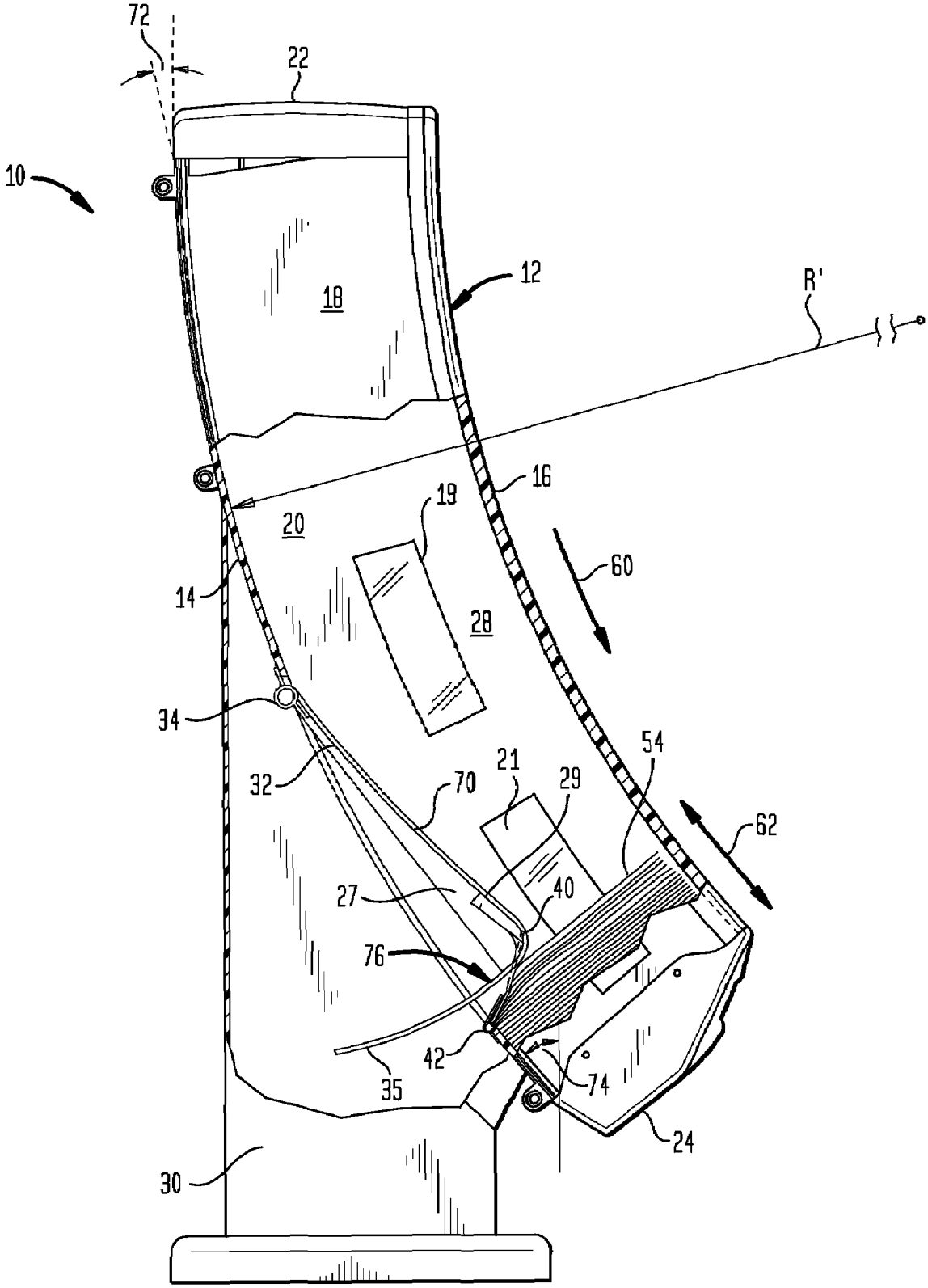
Figure 9:
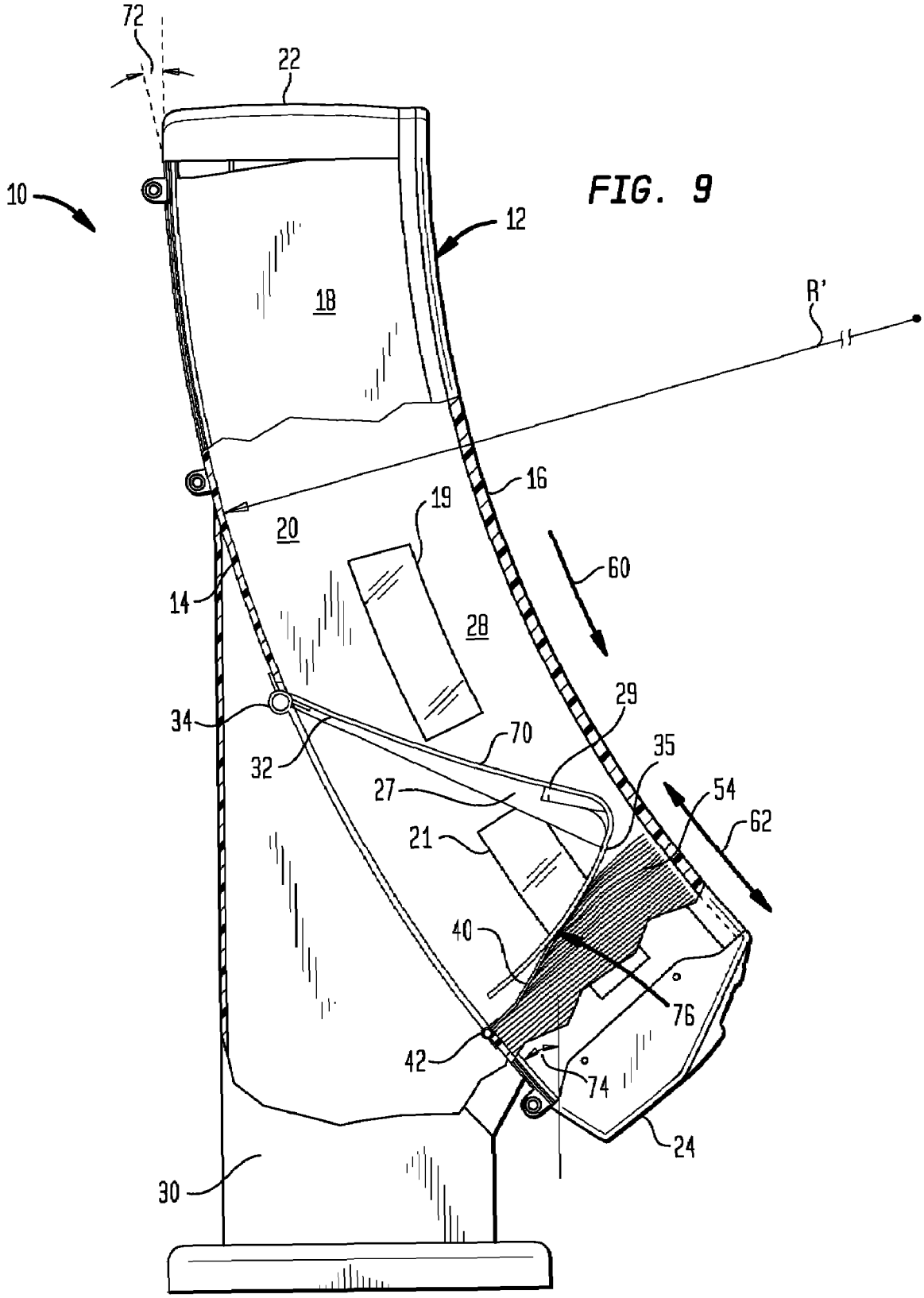

As the stack 54 is depleted the stack moves in the direction shown as 60 in FIGS. 7, 8 and 9. When the stack is depleted such that it approaches a predetermined length 62 shown schematically in FIGS. 8 and 9, blocker member 32 no longer has sufficient weight of the stack against it to hold it against wall 14.

At this point spring 36 urges member 32 upwardly as shown in FIGS. 3, 8 and 9 so that it bears against the upper surface of the stack. FIG. 8 is an intermediate position, wherein guide plate 40 directs napkins away from upper surface 70 of arm 32 so that they are not carried upwardly. That is, plate 40 acts as a leading guide plate forming a part of a blocking surface 76 which is in spaced facing relationship to aperture 26 when the blocking assembly is in the fully operative position shown in FIGS. 3 and 9, where blocking surface 76 extends substantially between back wall 14 and front wall 76. Preferably blocking surface 76 is spaced a distance of from about 0.5 to about 3 inches from aperture 26 in this position. Preferably, blocking surface 76 thus includes lower surface 35 of arm 32 as well as plate 40 as is seen in FIGS. 3 and 9 in particular. The blocking surface may consist only of surface 35 in particular embodiments if so desired; it is not necessary that the guide plate form a part of the blocking surface. Spring 36 is sufficiently powerful to overcome the downward force exerted by spring 44 on plate 40. Thus plate 40 is actuated by arm 32 as shown in FIGS. 8 and 9. That is, plate 40 rotates downwardly towards aperture 26 and directs the napkins away from upper surface 70 of arm 32. Plate 40 and blocking member 32 thus cooperate to keep the last napkins in the stack directly toward aperture 26. That is to say, the lower surface 35 of blocker arm 32 and plate 40 maintain the stack in proper position and restrict the stack from falling backwardly into the dispenser or being carried away from the aperture by way of the upper movement of member 32.

Note that plate 40 and recess 33 are dimensioned and configured so that plate 40 will not extend upwardly with respect to surface 70 and present an obstructing surface which could interfere with loading the dispenser. This geometry is achieved, for example, by dimensioning inflexed plate 40 to be substantially shorter than surface 35 and extending recess 33 into the lower portion of arm 32, that is, as shown particularly in FIG. 3 where recess 33 extends around the corner of the J-shaped arm so it is defined in part by surface 35.

The inventive dispenser is optionally provided with a convertible support suitable for mounting the dispenser on either a horizontal surface such as a countertop or a vertical surface such as a wall. The convertible feature minimizes the number of required parts. Most preferably, the convertible support includes a quick release base and bracket as described below.

Referring to FIGS. 10, 11, 12 and 13, there is shown dispenser 10 mounted on a convertible support 80 having an upper support member 82 with a wedge shaped lower end 84 as well as a lower support member 86 with an upper wedge shaped end 88. Also included is a base 90 and a mounting bracket 92 (See FIGS. 13, 14).

Member 82 is secured to member 86 such that the wedge shaped ends are in contact, providing mounting options depending upon their relative positions with respect to each other.

Figure 10:
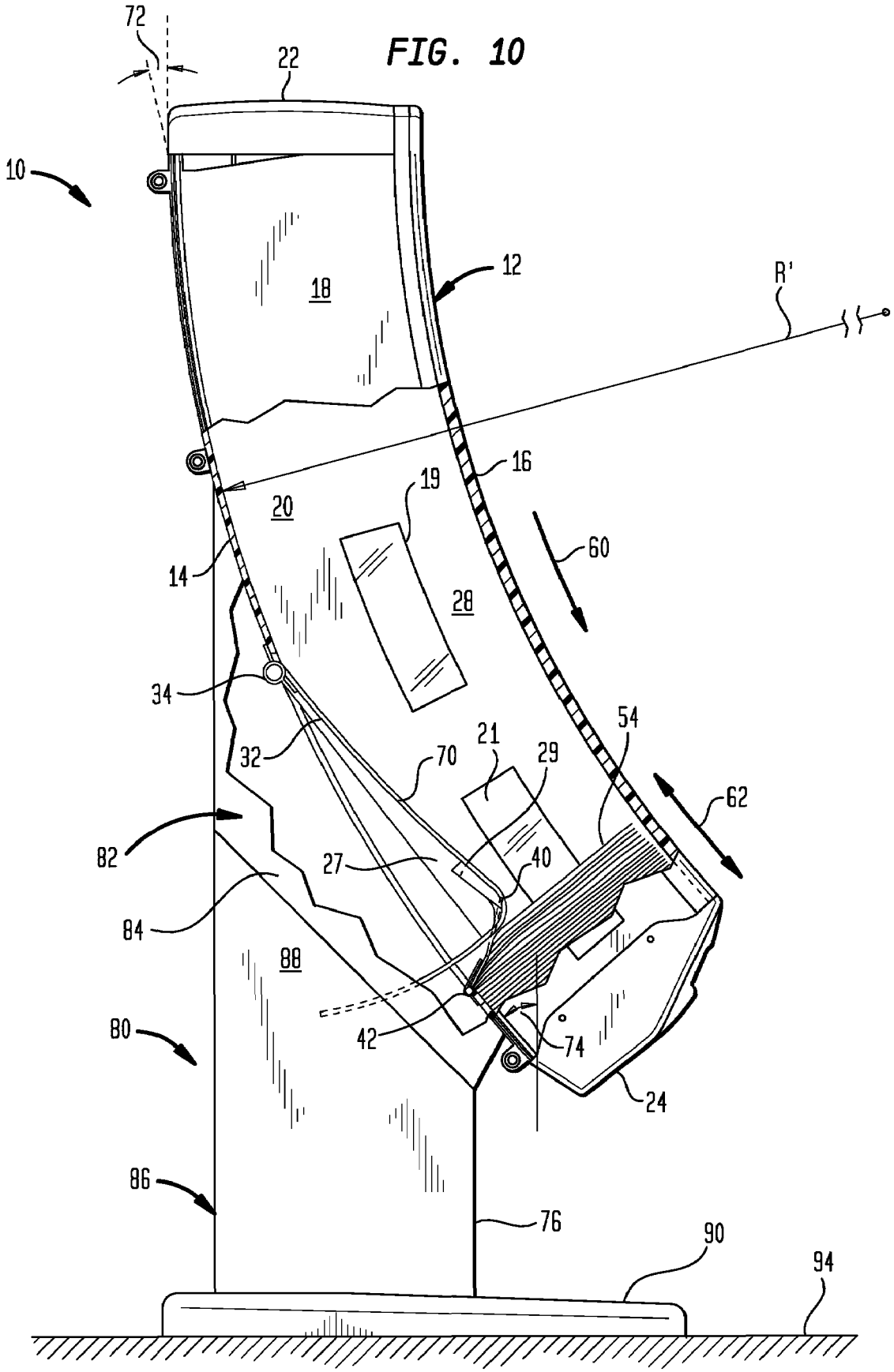
FIG. 10 is a schematic view in elevation of the inventive dispenser of FIG. 1 mounted on a countertop by way of a convertible support.

In FIG. 10, the dispenser is mounted on a countertop 94 and members 82, 86 are in a first relative position with respect to each other so that gravity feed dispenser 10 is supported in a vertical orientation as is shown.

Figure 11:
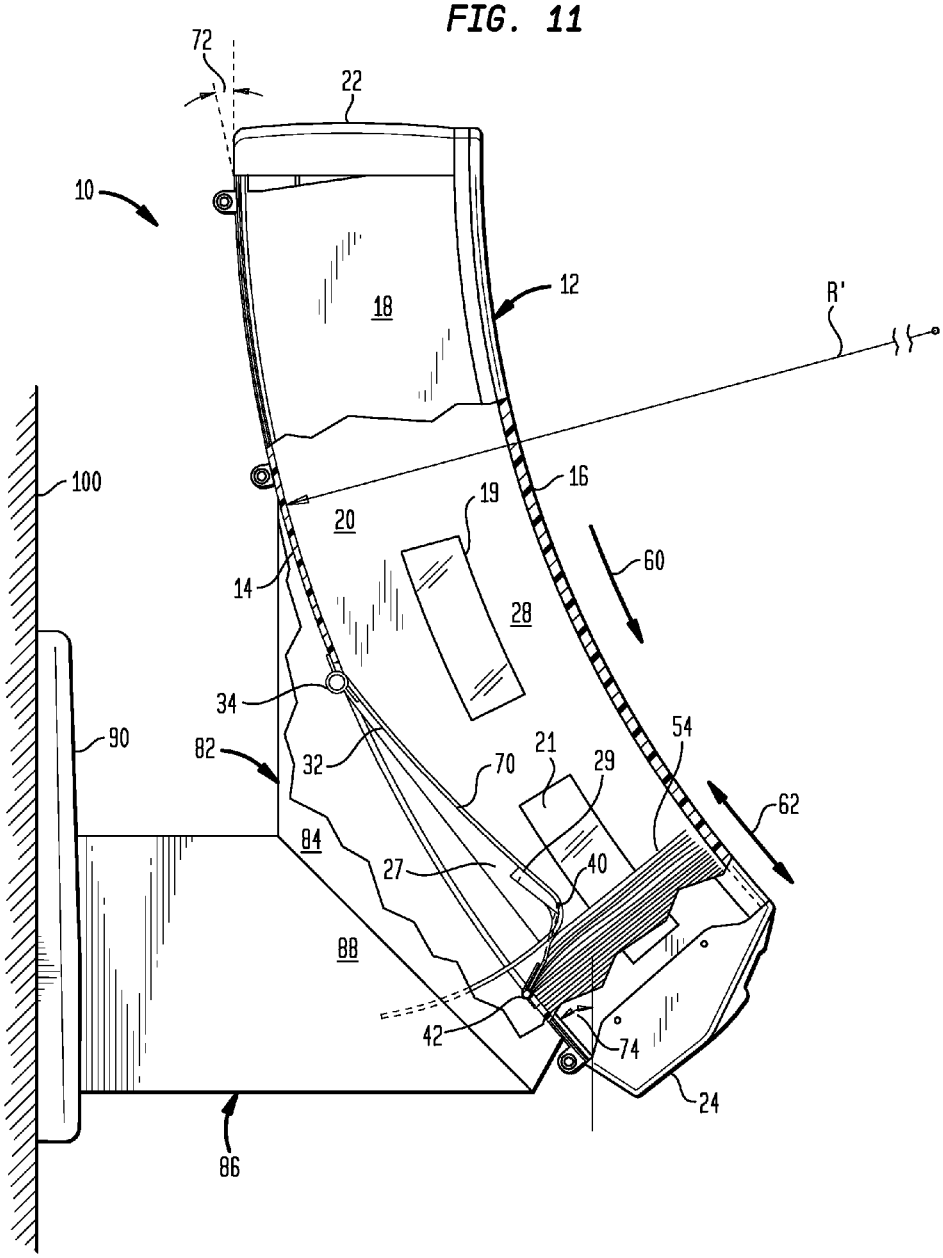
FIG. 11 is a schematic view in elevation of the inventive dispenser of FIG. 1 mounted on a wall by way of the convertible support shown in FIG. 10.
Figure 12:
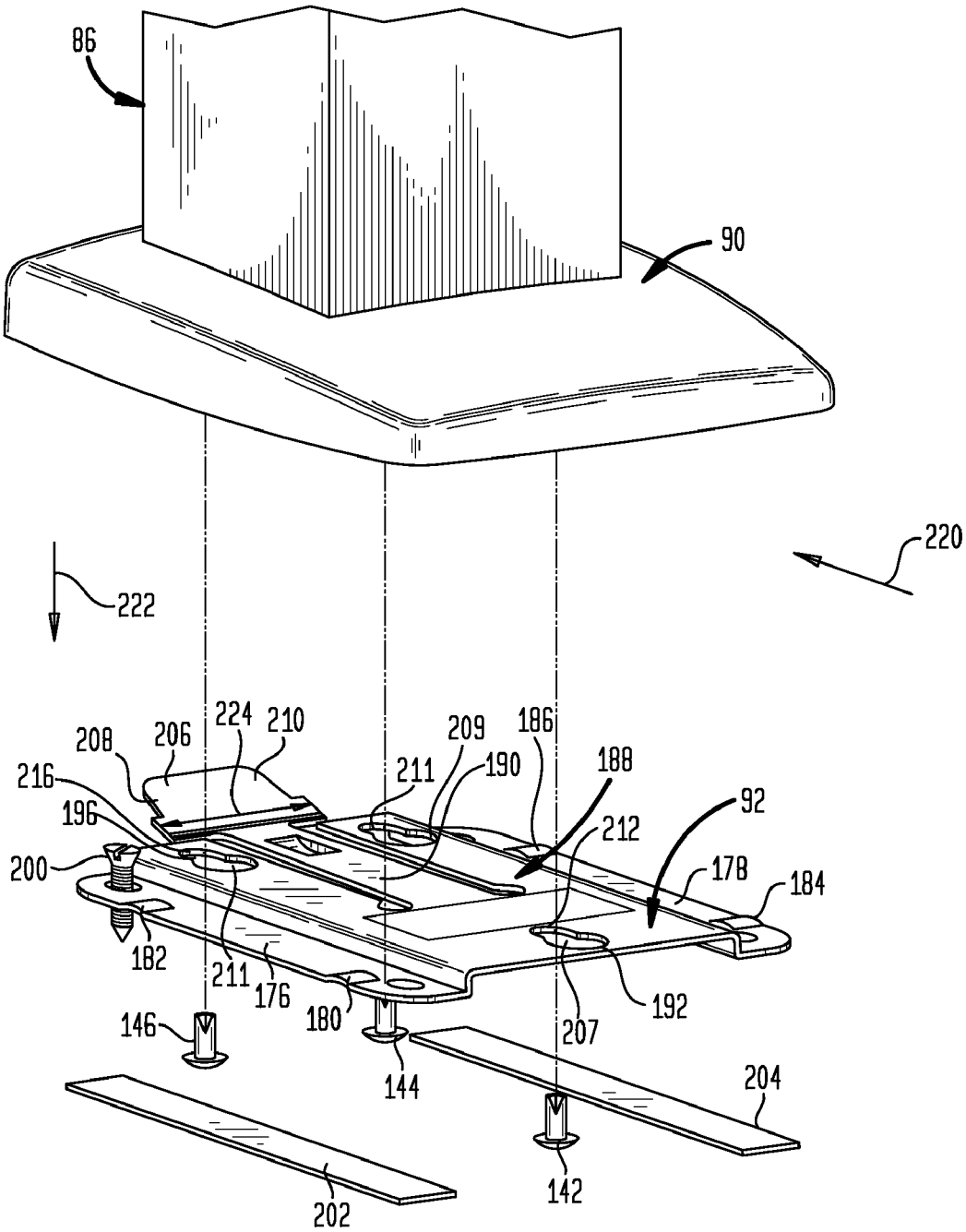
FIGS. 12 and 13 are exploded views of a base and mounting bracket of the convertible support of FIGS. 10 and 11.
Figure 13:
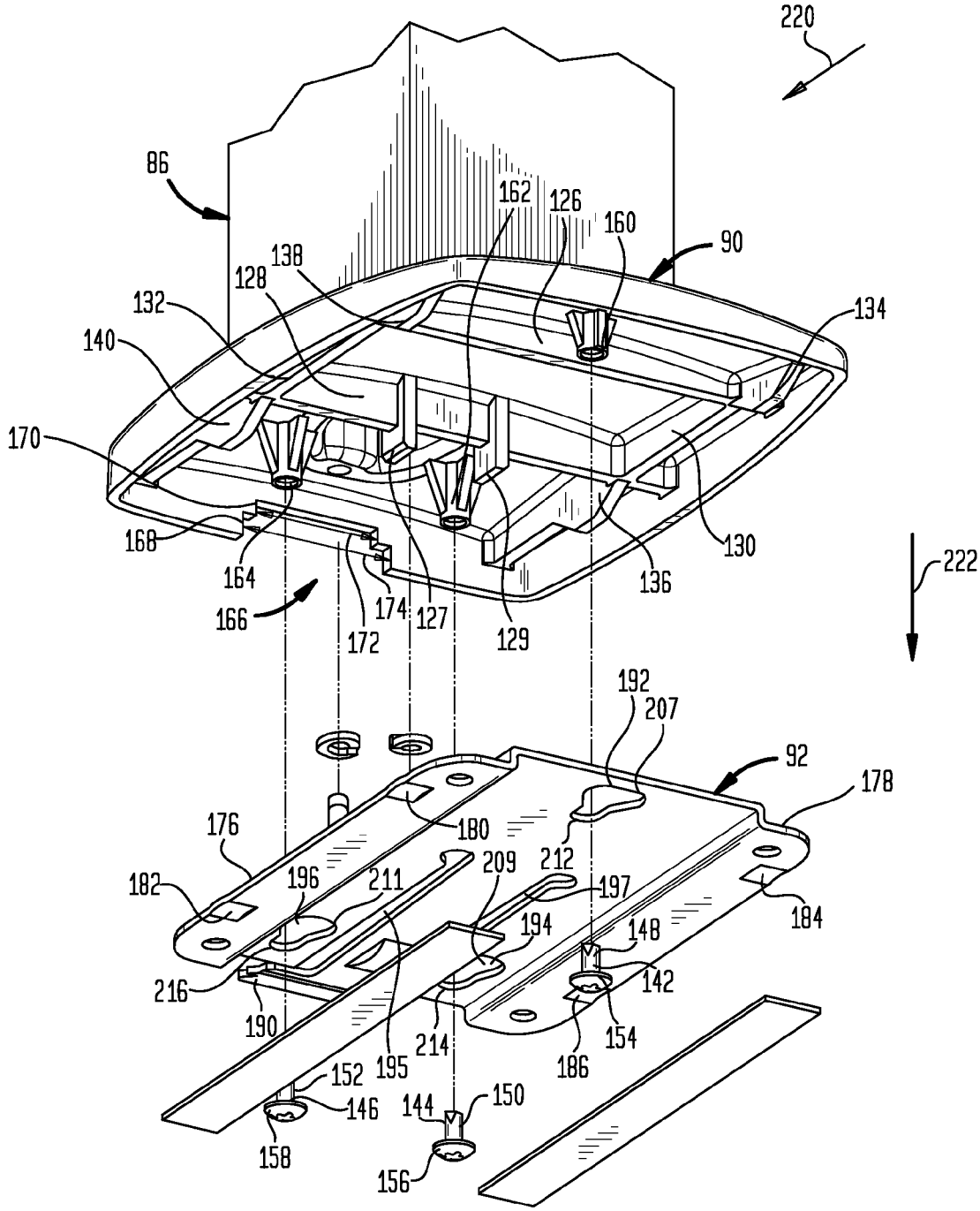

In FIG. 11, member 86 has been rotated 180° with respect to member 82 relative to the position shown in FIG. 10 to a second supporting position suitable for mounting the dispenser on a wall 100.

Member 86 is attached to base 90 in either configuration. Base 90 is suitably mounted to a wall or countertop by way of a quick release bracket 92 described further in connection with FIGS. 12 and 13 and also seen generally in U.S. Pat. No. 6,669,162.

Base 90 is provided with a plurality of ridges such as transverse ribs 126 and 128, guide ridges 127, 129 as well as longitudinal ribs 130 and 132. Ribs 130 and 132 are provided with ridges 134, 136, 138 and 140 as can be seen in the Figures. There is also provided on the base a plurality of locking projections in the form of fasteners 142, 144, and 146 each of which has a shaft 148, a shaft 150 and a shaft 152 as well as a head 154, a head 156 and a head 158. Fasteners may be screws or bolts or the like which are fitted to be secured in holes 160, 162 and 164 respectively defined on base 90. The fasteners operate as locking projections as will become apparent from the discussion which follows.

The base is further provided with a stepped recess 166 which has L-shaped profiles at his lower portion 168 and its upper portion 170 as is best seen in FIG. 3. Note that the width of the upper portion of recess 166 indicated at 172 is less than the width of the lower portion of recess 166 indicated at 174.

The base is specifically designed to cooperate with mounting bracket 92. Mounting bracket 92 has a left track 176 and a right track 178 each of which has a pair of arcuate projections 180, 182, 184, and 186 which interact with the ridges 134, 136, 138 and 140 of the base in order to urge the bracket and mounting base into contact with each other when the base is secured to the bracket. The bracket is further provided with a raised central portion 188 which has a tongue 190 as well as locking slots 192, 194 and 196. There are further provided guide slots 195, 197 on either side of the tongue. The mounting bracket is secured to a mounting surface by way of screws such as screw 200 or by way of double sided tape indicated at 202 and 204. Note that tongue 190 also has a stepped profile at its portion 206 notably having L-shaped profile on either of its sides at 208 and 210.

In order to secure the napkin dispenser to a mounting surface the mounting bracket 92 is first secured thereto. Base 90 is secured to the mounting bracket by way of fasteners 142, 146 and 148. That is to say, the fasteners are first inserted into the open portions 207, 209 and 211 of slots 192, 194, and 196 and then the entire base is slid rearwardly in the direction indicated by arrow 220 in FIG. 12 such that the fastener heads will be restrained from perpendicular translation by the narrow portions 212, 214, and 216 of slots 192, 194 and 196. When the base is slid rearwardly into the locking position the stepped profile of tongue 190 prevents the base from sliding forwardly to the release position until tongue 190 is pressed downwardly in the direction indicated by arrow 222. That is to say tongue 190 by virtue of the fact that its width at 224 is wider than the width 172 of the upper portion of the locking recess of base 90 prevents parallel or coplanar translation of the base away from the locking position until tongue 190 is pressed downwardly in the direction indicated by arrow 222 to a release position where the width 224 is below the upper portion of slot 166 as should be fully appreciated from the Figures. So also, the various raised portions of tracks 176 and 178, that is, raised portions 180, 182, 184 and 186 interact with the engagement ridges 134, 136, 138 and 140 of the base to urge the bracket and base into secure contact with one another so that the napkin dispenser will not rock when secures to countertop 198. In other words, the raised portions and ridges operate as biasing means to urge the parts together. Preferably, width 224 of tongue 190 is larger than width 172 of the upper portion of recess 166 but smaller than width 174 of the lower portion of stepped recess 166. In preferred embodiments, the base and bracket are urged into engagement before tongue 190 latches into place in its locking position in slot 166. So also, base 80 preferably includes guide ridges 127, 129 which cooperate with slots 195, 197 of the mounting bracket in order to orient the base with respect to the bracket and prevent unwanted snagging of the locking projections on slots or holes while the assembly is being locked into engagement. That is to say, ridges 127, 129 are configured to cooperate with slots 195, 197 in order to orient the base with respect to the mounting bracket as the base is being engaged with the mounting bracket.

While the invention has been described in detail above in connection with preferred embodiments, modifications within the spirit and scope of the invention, set forth in the appended claims, will be readily apparent to those of skill in the art. In view of the foregoing discussion, relevant knowledge in the art and references discussed above in connection with the detailed description and background of the invention, the disclosures of which are all incorporated herein by reference, further description is deemed unnecessary.

What is claimed is:

1. A dispenser comprising:

a housing including walls defining an interior for accommodating a stack of sheet products within the interior;

a dispensing aperture disposed at an end of the housing in communication with the interior;

a blocking assembly including a primary blocker arm, primary biasing means, a guide member and secondary biasing means, wherein:

the primary blocking arm, secondary biasing means and guide member being configured and adapted such that a weight of the stack of sheet products will substantially maintain the blocking assembly in a first position when the stack of sheet products is longer than a predetermined stack length and the primary biasing means will urge the blocking assembly toward a second position as the stack of sheet products approaches the predetermined stack length;

the guide member is biased away from the interior of the dispenser by the secondary biasing means in the first position of the assembly and is coupled to the primary blocker arm; and the guide member and secondary biasing means being further adapted such that the guide member projects into the interior of the dispenser housing upon movement of the blocking assembly toward the second position by motion of the primary blocker arm acting on the guide member to provide a guide surface operative to direct product away from the primary blocker arm and toward the dispensing aperture.

2. The dispenser according to claim 1, wherein the primary blocker arm is provided with a guide member recess wherein the guide member nests in the first position.

3. The dispenser according to claim 1, wherein the housing further comprises a sight glass.

4. The dispenser according to claim 1, further comprising a convertible support suitable for mounting the dispenser on either a countertop or wall, wherein the convertible support comprises:

an upper support member secured to the dispenser;

a lower support member secured to the upper support member, wherein the two support members are moveable with respect to each other between a countertop support arrangement and a wall support arrangement, the two members extending generally in the same direction in the countertop support arrangement and being generally orthogonal to each other in the wall support arrangement; and means for securing the convertible support to a mounting surface, wherein the support members are configured to support the dispenser in an upright orientation when the convertible support is secured to a horizontal support surface and the support members are in the countertop support arrangement relative to each other and wherein the support members are configured to support the dispenser in an upright orientation when the convertible support is secured to a vertical support surface and the support members are in the wall support arrangement relative to each other.

* * * * *